United States Patent [19]

Yonker

[11] 3,957,119

[45] May 18, 1976

[54] PUMP DOWN METHOD

[76] Inventor: John H. Yonker, P.O. Box 34380, Dallas, Tex. 75234

[22] Filed: Dec. 18, 1974

[21] Appl. No.: 533,946

[52] U.S. Cl. ..... 166/315
[51] Int. Cl.[2] ..... E21B 43/00
[58] Field of Search ..... 166/313, 315

[56] References Cited

UNITED STATES PATENTS

| | | | |
|---|---|---|---|
| 2,569,026 | 9/1951 | Springer | 166/313 UX |
| 3,208,529 | 9/1965 | Corley, Jr. | 166/313 X |
| 3,302,721 | 2/1967 | Yetman | 166/313 |
| 3,363,693 | 1/1968 | Bohlmann, Jr. | 166/313 |
| 3,378,080 | 4/1968 | Fredd | 166/315 X |
| 3,508,614 | 4/1970 | Bohlmann, Jr. et al. | 166/315 |
| 3,525,401 | 8/1970 | Hanson et al. | 166/315 |
| 3,656,552 | 4/1972 | Pollock, Jr. et al. | 166/315 |

*Primary Examiner*—Stephen J. Novosad
*Assistant Examiner*—George A. Suckfield

[57] ABSTRACT

A pumpable tool and method of utilizing the tool to perform an operation at a point axially spaced from a circulating means between a pair of conduits. The tool includes a pair of pistons one of which is associated with a bypass valve. The operation is performed by applying fluid pressure in both conduits with the bypass valve closed. The tool can be circulated out of one of the conduits when the bypass valve is open. This abstract is neither intended to define the invention of the application which, of course, is measured by the claims, nor is it intended to be limiting as to the scope of the invention in any way.

7 Claims, 6 Drawing Figures

PUMP DOWN METHOD

BACKGROUND OF THE INVENTION

1. Field of the Invention

This invention relates to a method of performing a desired operation in one conduit of a system having a pair of conduits and a connecting nipple providing communication between the conduits. More particularly this invention relates to a method of utilizing pump down tools to perform a desired operation in one tubing string of a well at a point axially spaced below from the connecting nipple when the upper locomotive piston of the pump down tool cannot be pumped past the circulating nipple to the work location.

2. The Prior Art

A well is equipped for pump down operations by providing two strings of tubing and a circulating nipple for fluid communication from one string of tubing to the other. Performing an operation, such as setting a tool, in the first string of tubing above the circulating nipple can be accomplished by pumping down a pump down piston locomotive and work tool in the first string of tubing and circulating fluid through the circulating nipple and up the second string of tubing. In this manner, no matter what the bottomhole pressure is, enough force can always be applied through the locomotive piston to the work tool to perform the desired operation. The pump down tools are removed from the well by pumping fluid down the second string of tubing and circulating fluid up through the first string of tubing.

Problems have arisen in the use of pump down equipment when it is desired to perform an operation below the circulating nipple in one of the tubing strings. To provide a means for removing the pump down equipment once the operation is performed the locomotive transport pistons must remain above the circulating nipple so that reverse circulation will be able to lift the equipment out of the tubing string. Extending from the locomotive pistons to the running tool is a stem. The stem may be a sucker rod. The stem is long enough so that the locomotive pistons can remain above the circulating nipple and the running tool can be run down to the desired work location. Sometimes a high differential pressure across the transport pistons is required to apply enough force to the work tool to perform the desired operation. Applying such force downward through the locomotive transport pistons causes the stem to buckle or corkscrew in the tubing. Thus the stem does not efficiently transmit force from the locomotive transport piston to the running tool. With the inefficient transmission of forces from the locomotive piston to the running tool, the operator is uncertain whether or not the desired operation has been properly performed below the circulating nipple.

OBJECTS OF THE INVENTION

It is the object of this invention to provide a method of utilizing pump down tools to insure an adequate transmission of forces to a running tool on one side of a circulating nipple when the locomotive, transport piston remains on the other side of the circulating nipple.

It is a further object of this invention to provide a method of utilizing pump down tools to enable fluid pressure to be exerted directly on a running tool on one side of a circulating nipple even though the locomotive, transport piston remains on the other side of the circulating nipple.

It is an additional object of this invention to provide a method of utilizing pump down tools, as in the preceding object, wherein the fluid pressure applied to the running tool may be effectively controllably released so that the pumpd down tool may be removed from the well.

Another object is to provide a method for utilizing pump down tools having an interconnected upper transport piston and lower force applying piston in which pressure may be applied through the lower piston and in which the effective area of the lower piston may be reduced to permit reverse circulation of the tool from a point intermediate the two pistons at the time of beginning reverse circulation.

These and other objects and features of advantage of this invention will become apparent from the drawings, the claims and the detailed description which follows.

BRIEF DESCRIPTION OF THE DRAWINGS

In the drawings wherein like numerals indicate like parts, and wherein an illustrative embodiment of this invention is shown.

DESCRIPTION OF THE PREFERRED EMBODIMENT

Figure 4:
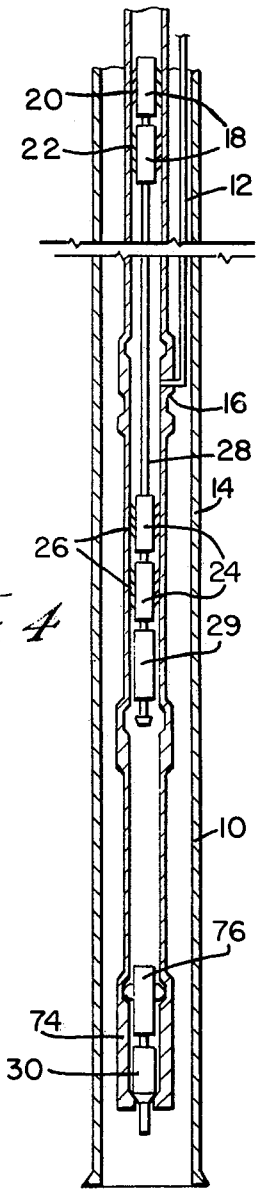
FIG. 4 is still another schematic view, partially in section, depicting a pump down tool being removed from the well after a tool has been landed in accordance with this invention.

The invention may be utilized in any system having a pair of conduits which are interconnected to provide for circulation in both directions. For convenience the invention will be disclosed as it applies to a petroleum well.

A well equipped for pump down operations has a pair of conduits, a communicating means between the conduits and some surface equipment. The pair of conduits is normally provided by a tubing string 10 and an auxiliary tubing 12. The tubing string 10 provides for production and the circulating tubing 12 provides for control. Of course the well could be equipped with only one string of tubing. The pair of conduits would then be provided by the string of tubing and the annulus between the string and the well casing. In the embodiment shown, the two strings 10 and 12 have been run in the well casing 14. The communicating means for providing fluid circulation between the two conduits may be a nipple 16 which is connected to the two conduits and has a circulating port between the conduits. When the well is equipped with a pair of tubing strings, the circulating nipple may be what is commonly called an H-member. When the well has only one tubing string the circulating nipple is a ported nipple. The surface equipment (not shown) includes a hydraulic pump to pump fluid in the conduits, a fluid storage tank, a manifold to control fluid volume and pressure, an instrument panel, and loops above the wellhead. The surface equipment employed may be as desired.

As shown in FIGS. 1 through 4, a tubing string 10 often extends in both directions from the performed nipple 16. Various operations are preformed at a location axially spaced from the circulating nipple 16 in the tubing string 10 while for reasons to be hereinafter explained a pump down transport piston remains on the opposite side of the circulating nipple 16. These operations include shifting a sleeve in the tubing, opening a valve, closing a valve, setting a tool or retrieving a tool. With an appropriate running tool, the pump down tool, utilized in the manner hereinafter described, can perform a desired operation at a location axially spaced from the circulating nipple 16 and yet it will be possible to remove the pump down tool from the tubing 10.

The pump down tool may include two spaced piston means, connecting means for connecting the pistons together and a bypass valve means associated with one piston. Preferably each piston means is a set of pistons.

One set of pistons 18 will be the transport, or locomotive pistons. The set of transport pistons 18 has piston cups 20 that point in a first direction and piston 22 that point in a second direction. The piston cups 20 and 22 create an effective seal with the wall of the tubing 10. Fluid pumped in a first direction in the tubing 10 will seep past piston cups 20 and will engage piston cups 22. The engagement of the fluid with piston cups 22 of the transport pistons 18 provides a locomotive force to move the pump down tool in a first direction in the tubing 10. Likewise, fluid pumped in a second direction in the tubing will seep past piston cups 22, will engage piston cups 20 and will provide a locomotive force to move the pump down tool in a second direction in the tubing. Any design of pump down piston may be utilized as long as it is capable of responding to applied fluid pressure in either direction to provide locomotion for the pump down tool in either direction. If desired a series of transport pistons 18 may be provided and the pistons run in tandem to obtain additional thrust for operating the pump down tool.

The other set of pistons 24, the set associated with the bypass valve means is a ported bypass set of pistons. The bypass set of pistons 24 has piston cups 26 that point in the same second direction as piston cups 22. When fluid pressure is applied in tubing 10 in a first direction, if the bypass valve means is closed, the fluid engages piston cups 26 and the ported bypass set of pistons 24 is a force transmission means. The force is transmitted in the first direction. A series of ported bypass pistons 24 may be provided and the pistons 24 run in tandem to obtain additional force, if desired.

Connecting the set of transport, locomotive pistons 18 with the set of ported bypass pistons 24 is a connecting means 28. The connecting means 28 may be a stem comprising a series of connecting reach rods joined together. If the pump down tool does not have to be circulated through a small radius (3 to 5 feet) curve in the tubing, the connecting rods can be joined together by a pin and box connection. If the pump down tool is circulated through a small radius curve of tubing, the connecting rods are joined together by ball joints. The length of the connecting rods is such that they can be circulated through the smallest radius curve of tubing in the tubing strings. Where ball joints are used they are preferably slightly smaller in diameter than the inner diameter of the tubing to maintain the rods in alignment. The stem connecting means maintains the spaced relationship between the transport, locomotive pistons 18 and the ported bypass pistons 24. The length of the stem connecting means 28 is such that the transport, locomotive pistons 18 can remain on one side of the circulating nipple 16 while the ported bypass pistons 24 are run past the circulating nipple 16 to the work location.

Also connected to the ported bypass set of pistons 24 is a running tool 29. The running tool 29 is designed to perform the desired operation in the tubing string 10. In the drawings, the illustrated running tool is being utilized to set a tool 30.

Figure 5:
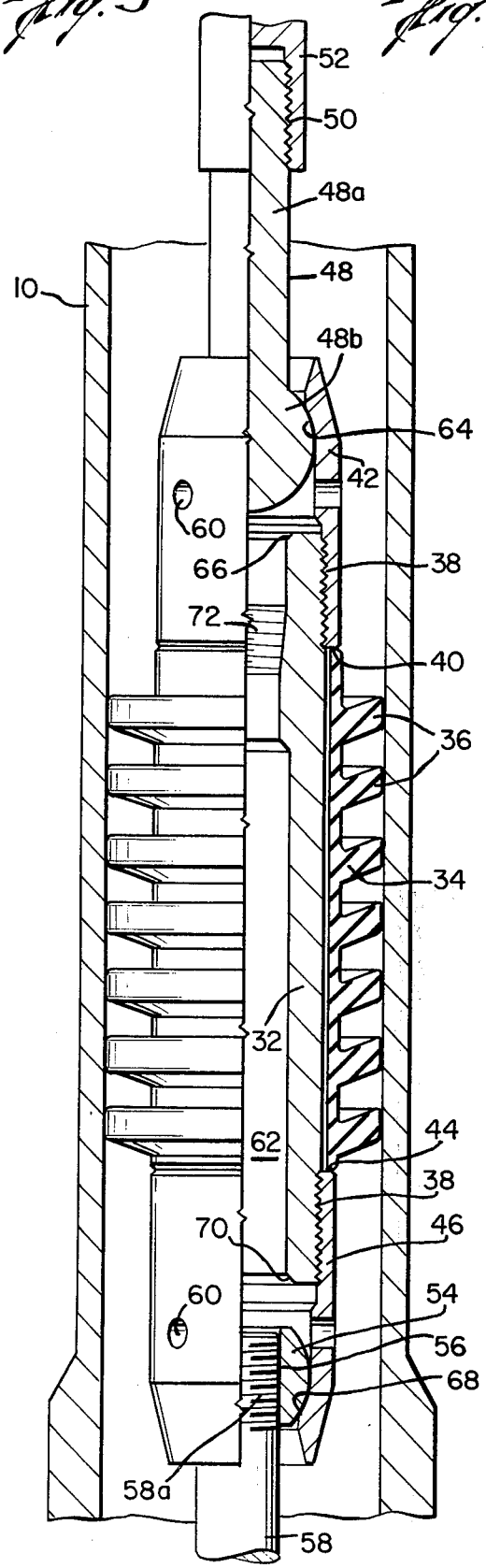
FIG. 5 is a side view, partially in section and partially in elevation, of one of the set of ported, bypass pistons in a tubing that is utilized with a pump down tool in accordance with this invention.

Referring now to FIG. 5 there is depicted the detailed construction of one of a set of pistons. The piston, as depicted, may be utilized as the ported bypass piston 24 while modified version may be utilized as the transport, locomotive piston 18.

Forming the body of the piston is a mandrel 32. Surrounding the mandrel 32 is a piston element 34. The cups 36 of the piston element 34 are capable of engaging the internal wall of the tubing string 10 so that the pump down tool may be pumped in at least one direction through the tubing string 10. The piston cups 36 of the piston depicted in FIG. 5 are pointed upward so that the piston could be pumped downward in the tubing string 10. However, it is to be understood that the piston element 34 could simply be reversed, and then the piston could be pumped upward in the tubing string 10. Since the piston may be pumped through a small radius curve in the tubing string, the means for connecting the piston to other devices in the pump down tool is capable of undergoing universal pivotal movement. Another design feature of the connecting means, to facilitate the makeup of the pump down tool out in the field, is that male threaded connections face upwards while female threaded connections face downward.

Ball joints are provided at each end of the piston to permit articulation. At either extremity of the mandrel 32 there are means 38 for threadably attaching an end connector to the mandrel 32. The piston element 34 is confined on the mandrel 32 between a downward facing shoulder 40 of the upper end connector 42 and an upward facing shoulder 44 of the lower end connector 46. Before the upper end connector 42 is threaded onto mandrel 32 a stem ball connector 48 is inserted into the upper end connector 42 with the stem extension **48*a* extending upward through the end connector 42. The upwardly extending stem extension 48*a* has threads 50 to provide the upward facing male threaded connecting means desired for field operations. The stem ball connector 48 also has a lower ball portion 48*b* which is confined in an internal housing of the upper end connector 42. The confinement of the ball portion 48*b* within the housing of the upper end connector 42 with the stem extension 48*a* extending through a circular opening in the upper end connector 42 permits universal pivotal movement of any device or connection 52 that may be threaded onto the stem ball connector 48** relative to the set of pistons.

Before the lower end connector 46 is threaded onto mandrel 32 a ball connector 53 is inserted into the lower end conductor 46. The ball connector 54 has internal, female threads 56 to provide the downward facing female threaded connecting means desired for field operations. A rod connector 58 with an upward facing male threaded end 58*a* is threaded into the ball connector 54. When the lower end connector 46 is threaded onto the mandrel 32, the ball connector 54 is confined in an internal housing of the lower end connector 46. With the rod connector 58 extending through a circular opening in the lower end connector 46, and device that is attached to the rod connector 58 may undergo limited universal pivotal movement with respect to the piston.

In accordance with this invention bypass valve means are provided in the bypass piston which is closed when the connecting rod is in compression and open when the rod is in tension. The balls 48*b* and 54 and the end connectors 42 and 46 provide a portion of the bypass valve means associated with the bypass pistons. The bypass valve means is designed so that when the valve is open the cross sectional area of the pistons is greatly reduced. If two sets of pistons were connected together and placed in a tubing 10 and if each set of pistons had the piston element arranged so that the cups 36 were facing each other, and if fluid under pressure was being injected into the tubing 10 between the sets of pistons, and if one set of pistons had the bypass valve means open and the other set of pistons had no bypass valve means even though the fluid pressure applied to each set of pistons would be equal, the reduction in area to the one set of pistons caused by the open bypass valve means would result in the force being applied to that set of pistons being less than the force applied to the other set of pistons. The connected pistons would move in reaction to the net force applied to the other set of pistons. In the set of pistons depicted in FIG. 5, the bypass valve means is provided by having at least one bypass port 60 in both the upper end connector 42 and in the lower end connector 46 and by having a bore 62 extend through mandrel 32. The ball portion 48b of the ball stem connector 48 is slidable, axially within the housing of the upper end connector 42 between an annular downward facing shoulder 64 of the end connector 42 and an annular upward facing shoulder 66 of the mandrel 32. Likewise, the ball connector 54 is slidable axially within the housing of the lower end connector 46 between an annular upward facing shoulder 68 of the end connector 46 and an annular downward facing shoulder 70 of the mandrel 32. When the ball portion 48*b* is seated on annular shoulder 66 of mandrel 32 and when the ball connection 54 is seated on annular shoulder 70 of mandrel 32 the bypass ports 60 are closed as is the bore 62 of mandrel 32. Thus seating the balls, which may be done by placing the stem ball connection 48 and the rod connection 58 in compression, will close the bypass valve means. The upper locomotive pistons 18 are identical with the lower pistons except that a plug (not shown) is received in threads 72 in mandrel 32 to close the bore through the mandrel. The ports 60 may also be omitted.

When the pump down tool that will be utilized to perform a desired operation in accordance with this invention is made up sets of pistons, as described above, with a plug valve may be utilized as the set of transport locomotive pistons 18. As has been mentioned, the piston element 34 will be placed on the mandrel 32 so that the cups 36 are pointed in the desired direction. For the bypass unloader set of pistons, the set of pistons, as described above, without a plug valve is utilized.

Figure 6:
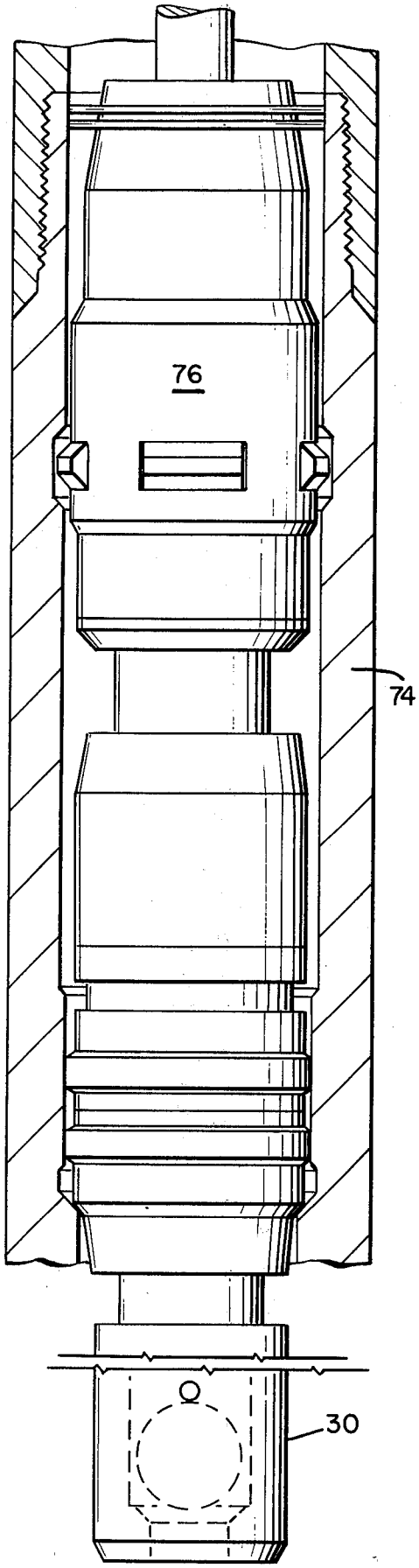
FIG. 6 is a side view, partially in section and partially in elevation of a standing valve in a nipple that has been set utilizing the pump down tool and method of this invention.

Although any desired operation in the well tubing may be performed utilizing the pump down tool above described, FIGS. 1 through 4 schematically show the landing of a standing valve 30 in a no-go landing nipple 74 in the tubing 10. FIG. 6 illustrates the landed standing valve. For a detailed description of the operation of the running tool 29 which is utilized to set the lock mandrel 76 of the standing valve 30 reference is made to U.S. Pat. application Ser. No. 405,084 filed Oct. 10, 1973, the disclosure of said application being hereby incorporated by reference for all purposes. In practicing the method of this invention, the aforedescribed pump down tool with the set of transport pistons 18, the set of bypass pistons 24, the connecting means 28 maintaining the transport pistons 18 in spaced relation to the bypass pistons 24 and the bypass valve means is utilized to perform an operation in a well conduit in a well equipped for pump down operations at a location axially spaced from the circulating nipple 16. When the pump down tool is in position to perform the desired operation, the reach rod connecting means 28 extends from the running tool at the work location at a point axially spaced from the circulating nipple 16 below the nipple 16, to the transport pistons on the opposite side of the circulating nipple 16 above the nipple 16.

Figure 3:
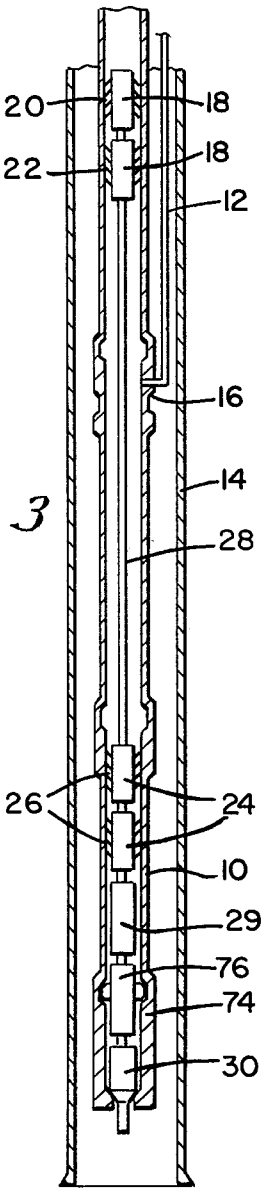
FIG. 3 is another schematic view, partially in section showing a pump down tool landing a tool in a well in accordance with this invention.
Figure 2:
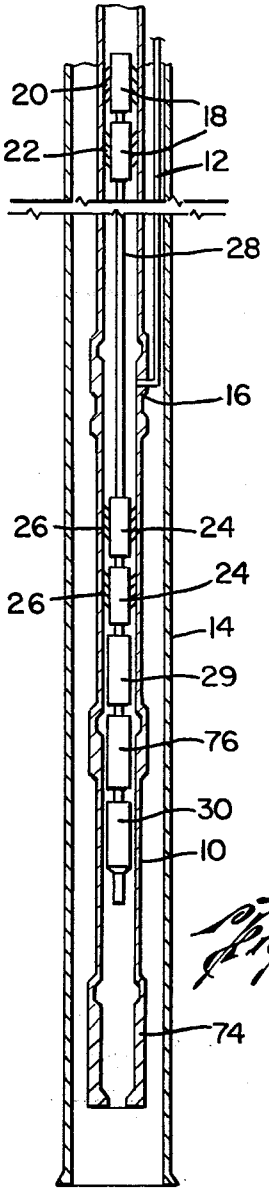
FIG. 2 is another schematic view, partially in section, depicting a pump down tool after it has been further run down a well in accordance with this invention.
Figure 1:
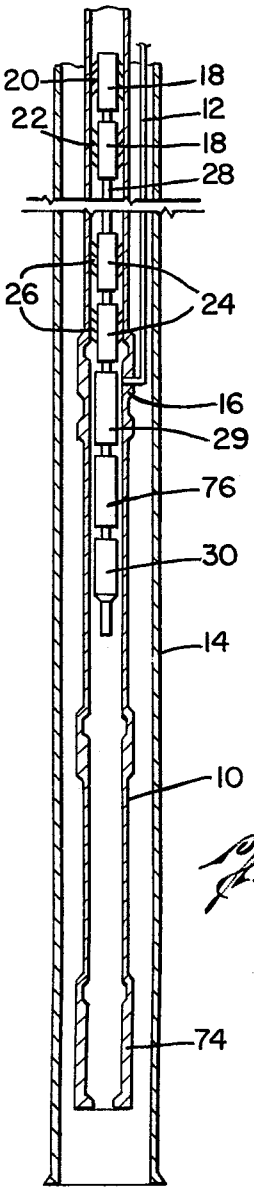
FIG. 1 is a schematic view, partially in section, showing an initial phase of running a pump down tool down a well in accordance with this invention.

Referring now to FIGS. 1 through 4 the method of utilizing the pump down tool will be described. The well has a pair of conduits, and the pump down tool is made up to be run in one of the conduits in which it is desired to perform an operation. The pump down tool is inserted in the one circuit and fluid is pumped in a first direction in the conduit to move the pump down tool through the conduit in a first direction. In FIGS. 1 and 2 the pump down tool is being pumped down the production tubing 10. The fluid pressure of fluid pumped in a first direction to move the pump down tool in a first direction is greater than the pressure in a second direction of other fluids that may be in the one conduit. These other fluids may be associated with the well production. These production fluids create downhole pressure and retard the downward movement of the pump down tool. In FIGS. 1, 2 and 3 the downhole pressure would be exerted upward through tubing string 10 against the tool 30 at the lower end of the pump down tool.

In FIG. 3 the pump down tool is illustrated after having been pumped in a first direction, which in the drawing would be downward, with the running tool 29 in position to perform the desired operation at a point axially spaced from the communicating means between the well conduits. The pistons bridge the communicating means with the transport pistons 18 being on one side and the bypass pistons 24 being on the other side at the work location with the running tool. The connecting means 28 maintains the spaced relationship between the pairs of pistons. The illustrated work location is the landing nipple 74 in production tubing 10 below circulating nipple 16. The standing valve 30 is shown, in FIG. 3, in a position to be landed in the landing nipple 74. The running tool 29 and the bypass pistons 24 are in position to perform the operation of landing the standing valve 30 in the landing nipple 74. They are thus illustrated as being below the circulating nipple 16. The transport pistons 18 are on the opposite side of the circulating nipple 16 above the nipple 16. The reach rod connecting means 28 maintain the spaced relation between the pair of pistons and extend from the transport pistons 18 to the bypass pistons 24.

With the pump down tool in position, the desired operation can be performed. While the operation is beign performed, the bypass valve means associated with the bypass piston 24 is closed. The bypass valve means is closed by the application of fluid pressure in a first, (as illustrated, downward) direction to place the connecting means 28 in compression. With the connecting means 29 in compression, the ball portion 48*b* of the ball stem connector 48 seats an annular shoulder 66 of the mandrel 32 and the ball connector 54 seats on the annular shoulder 70 of the mandrel 32. The seating of the balls blocks bypass ports 60 and closes bore 62 to close the bypass valve means.

To perform the desired operation, fluid pressure is applied in the pair of well conduits in a first direction simultaneously. In the well system illustrated in FIG. 3, fluid pressure would be applied in a downward direction in the production tubing 10 and in a downward direction in the circulating tubing 12. The application of fluid pressure in the second conduit, e.g., the circulating tubing 12, provides a column of fluid between the transport pistons 18 and the bypass pistons 24. The fluid pressure is adjusted to maintain the bypass valve means closed. Since the bypass valve means is closed when the connecting means 28 is in compression, the fluid pressure in the one conduit where the operation is being performed, e.g., the production tubing 10, is at least as great as the fluid pressure in the other, second conduit, e.g., the circulating tubing 12. Preferably the fluid pressures in both conduits are equal. With the fluid pressures in the conduits equal, the forces exerted on the transport pistons 18 would equalize out since they would be equal and opposite so that the net result would be that zero force would be transmitted across the transport pistons 18. However the column of fluid between the transport pistons 18 and the bypass pistons 24 would exert a force in a first direction, the illustrated direction is downward, on the bypass pistons 24. The force exerted on and through the bypass pistons 24 is sufficient to perform the desired operation. If the pressure applied in the one conduit, e.g., the production string 10, is greater than the pressure applied in the other conduit, e.g., the circulating string, then a net force in a first direction would be transmitted across the transport pistons 18. This force would be transmitted through the column of fluids between the transport pistons 18 and the bypass pistons 24 and through the bypass pistons 24 to contribute to the performance of the operation. The illustrated running tool 29 will land standing valve 30 in landing nipple 74 in the manner described in the aforementioned patent application. If needed a suitable probe may be carried by the running tool to maintain the standing valve member off its seat until the running tool releases the standing valve.

After the desired operation has been performed, the pump down tool can be removed from the work location of the well conduit. To remove the pump down tool, a net force in a second direction is applied to the transport pistons 24. A resultant force in a second direction across the transport pistons may be obtained by relieving the pressure in the one well conduit until it is less than the pressure in the other well conduit. In the sequence illustrated in FIG. 4 this would be done by relieving the applied fluid pressure in production tubing 10, while fluid pressure is continued to be applied in the circulating tubing 12. With the pressure of the column of fluids between the transport pistons 18 and the bypass pistons 24 being greater than the pressure of the fluids on the other side of the transport pistons 18, the connecting means 28 is placed in tension, the ball connector 48 and the ball connector 54 go off seat and the bypass valve means opens. The opening of the bypass valve means effectively reduces the cross sectional area of the bypass pistons 24. The cross sectional area of the transport piston 18 is not reduced. The pumping of fluid in a first direction in the second conduit maintains a column of fluid under pressure between the transport pistons 18 and the bypass pistons 24. Because of the difference in effective cross sectional area of the sets of pistons, the fluid pressure exerted on the transport pistons 18 provides a greater force in a second direction than the fluid pressure exerted on the bypass pistons 24 provides in a first direction. As illustrated in FIG. 4, fluid pumped down the circulating tubing 12 will enter the production tubing 10 through circulating nipple 16, will apply a force in an upward direction to the transport pistons 18 while flowing through the bypass pistons 24 and will lift the pump down tool out of the production tubing 10. Once the entire pump down tool has been lifted above the circulating nipple 16, continued pumping of fluid down the circulating tubing 12 will continue the lifting of the pump down tool from the tubing in the conventional manner.

From the foregoing description it can be seen that the objects of this invention have been obtained. A pump down tool, and a method of utilizing a pump down tool has been provided whereby a desired operation in a well conduit of a well equipped for pump down operations at a location axially spaced from a communicating means between conduits can be efficiently performed through the application of fluid pressure directly to the running tool and yet the pump down tool can be removed from the work location.

The foregoing disclosure and description of the invention are illustrative and explanatory thereof and various changes in the process, or in the size, shape and materials, as well as changes in the details of the illustrated construction may be made within the scope of the appended claims without departing from the spirit of the invention.

What is claimed is:

1. The method of performing a desired operation in one conduit of a system having a pair of conduits interconnected at a point axially spaced from the work location; said method utilizing a tool having a pair of spaced pistons one being a transport piston and the other being a bypass piston connected together by connection means and having a bypass valve means associated with the bypass piston which is open when the connecting means is placed in tension and is closed when the connecting means is placed in compression including the steps of:

pumping said tool in a first direction in said one conduit until the pistons bridge the interconnection of the pair of conduits and the bypass piston is in a position to perform the desired operation at the work location and the connecting means is in compression, applying fluid pressure in the pair of conduits simultaneously with the pressure applied to said one conduit being at least as great as the pressure applied in the other conduit which provides a column of fluid between the spaced pistons through which force is exerted in said first direction and the desired operation is performed, removing said tool from the work location in said one conduit by providing a pressure in said one conduit which is less than that in the other conduit to place the connecting means in tension and open said bypass valve means, and pumping fluid into said other conduit to move said tool in a second direction.

2. The method of performing a desired operation in one well conduit, the well having a pair of conduits interconnected above the work location; said method utilizing a pump down tool having a pair of spaced pistons connected together by connecting means and having a bypass valve means associated with the lower piston which is open when the connecting means is placed in tension and is closed when the connecting means is placed in compression including the steps of:

pumping said pump down tool down one well conduit until the pistons bridge the interconnection of the pair of conduits and the lower piston is in a position to perform the desired operation at the work location and the connecting means is in compression, applying fluid pressure in the pair of conduits simultaneously with the pressure applied to said one well conduit being at least as great as the pressure applied in the other conduit which provides a column of fluid between the spaced pistons through which force is exerted in a downward direction and the desired operation is performed, removing said pump down tool from the work location in said one well conduit by providing a pressure in said one well conduit which is less than that in the other conduit to place the connecting means in tension and open said valve means, and pumping fluid down said other conduit to circulate said pump down tool from said one well conduit by moving said pump down tool in an upward direction.

3. The method of performing a desired operation in a well conduit, the well having a pair of conduits interconnected at a point axially spaced from the work location; said method utilizing a pump down tool having a pair of spaced pistons one being a transport piston and the other being a bypass piston connected together by connecting means and having a bypass valve means associated with the bypass piston which valve means is open when the connecting means is placed in tension and is closed when the connecting means is placed in compression including the steps of:

pumping said pump down tool in a first direction in said well conduit with the pressure applied in a first direction by the pumped fluid being greater than the pressure applied to the pump down tool in a second direction by other fluids in said well conduit until the pistons bridge the interconnection of the pair of conduits and the bypass piston is in a position to perform the desired operation at the work location and the connecting means is in compression, applying fluid pressure in the pair of conduits simultaneously in said first direction, adjusting the fluid pressure in the pair of conduits until the pressure in the other conduit provides a force in a first direction through the bypass piston that is sufficient to perform the desired operation and the pressure in said well conduit is at least as great as the pressure in the other conduit, providing a fluid pressure in said well conduit which is less than that in the other conduit to place the connecting means in tension and open the valve means, and pumping fluid in said first direction in said other conduit to circulate said pump down in a second direction in said well conduit.

4. The method of performing a desired operation in a well conduit, the well having a pair of conduits interconnected above the work location; said method utilizing a pump down tool having a pair of spaced pistons connected together by connecting means and having a bypass valve associated with the lower piston which is open when the connecting means is placed in tension and is closed when the connecting means is placed in compression including the steps of:

pumping said pump down tool down said well conduit with the pumped fluid applying a downward pressure greater than the pressure in said well conduit below the tool until the pistons bridge the interconnection of the pair of conduits and the lower piston is in a position to perform the desired operation at the work location and the connecting means is in compression, applying fluid pressure in the pair of conduits simultaneously in a downward direction, adjusting the fluid pressure in the pair of conduits until the pressure in the other conduit is sufficient to perform the desired operation and the pressure in said well conduit is at least as great as the pressure in the other conduit, providing a fluid pressure in said well conduit which is less than that in the other conduit to place the connecting means in tension and open the valve means, and pumping fluid down the other conduit to circulate said pump down tool up said well conduit.

5. The method of performing a desired operation in one conduit, the system having a pair of conduits, a connecting nipple means between the conduits, and a work location in one conduit at a point axially spaced from the connecting nipple means; said method utilizing a tool having a set of transport pistons movable by fluid pumped in a first direction and in a second direction in said one conduit, a set of bypass pistons adapted to be engaged by fluid being pumped in a first direction in said one conduit, connecting means for spacedly connecting said set of transport pistons to said set of bypass pistons, said bypass pistons having bypass valves which are open when the connecting means is placed in compression, and a work tool attached to the set of bypass pistons including the steps of:

pumping said tool in a first direction in said one conduit while circulating fluid in a second direction in the other conduit until the work tool is at the work location, and the connecting means is in compression with the set of bypass pistons on the same side of the circulating nipple as the work tool and the transport pistons on the opposite side of the circulating nipple, applying fluid pressure in the pair of conduits simultaneously in a first direction with the pressure applied to said one well conduit being at least as great as the pressure applied in the other conduit providing a column of fluid between said set of transport pistons and said set of bypass work pistons through which force is exerted in said first direction on the work tool, and removing said tool from said one conduit by providing a pressure in said one conduit which is less than that in the other conduit to place the connecting means in tension and open said valve, and pumping fluid in a first direction in said other conduit while circulating fluid in a second direction in said one well conduit.

6. The method of setting or retrieving a tool in a well conduit; said well having a pair of conduits, interconnecting means between the conduits, and a landing nipple in said well conduit below the interconnecting means; said method utilizing a pump down tool having a set of transport pistons, a set of bypass pistons, connecting means for spacedly connecting said set of transport pistons to said set of bypass pistons, bypass valve means associated with said bypass piston which is open when said connecting means is placed in tension and is closed when said connecting means is placed in compression, and attaching means for setting or retrieving a tool attached to the set of bypass pistons including the steps of:

pumping said running tool in a first direction in said well conduit until the pistons bridge the interconnecting means between the conduits with the set of transport pistons above the interconnecting means and the tool is in a position to set or retrieve a tool from the landing nipple and the connecting means is in compression, applying fluid pressure in the pair of conduits simultaneously with the pressure applied to said well conduit being at least as great as the pressure applied in the other conduit until a column of f' 'l is provided between said set of transport pistons and said set of lower work pistons through which force is exerted in said first direction until the tool is set or the attaching means engages a tool in the landing nipple, and removing said running tool from said well conduit by providing a pressure in said well conduit which is less than that in the other conduit to place the connecting means in tension and open said valve means, and pumping fluid into said other conduit which engages said set of transport pistons to circulate said running tool from said well casing by moving it in a second direction.

7. The method of performing work in a well having two tubing strings at a location below communicating means between said two tubing strings, said method utilizing a pump down tool having a pair of spaced pistons connected together by a stem connecting means and having a bypass valve means associated with the lower piston which is open when the stem connecting means is in tension and is closed when the stem connecting means is in compression including the steps of:

pumping said pump down tool in a first direction in one tubing string until the lower piston is in a position to perform work at the work location and the stem connecting means is in compression with the upper piston above the communicating means, pumping fluid in the two tubing strings in a first direction simultaneous with the pressure being applied by the fluid in said one tubing string being at least as great as the pressure applied by the fluid in the other tubing string until the work is performed through the exertion of a force through the column of fluid between the spaced pistons, removing said pump down tool from said one tubing string by relieving the pressure in said one tubing string to a pressure less than the pressure in the other tubing string to place the stem connecting means in tension and open the valve means, and pumping fluid into said other tubing string thereby circulating said pump down tool from said one well tubing.

* * * * *